United States Patent [19]

Korn

[11] Patent Number: 4,707,029

[45] Date of Patent: Nov. 17, 1987

[54] APPARATUS FOR SUPPORTING PARTS OF FURNITURE

[75] Inventor: Heinrich Korn, Maintal, Fed. Rep. of Germany

[73] Assignee: Roder GmbH Sitzmobelworke, Frankfurt, Fed. Rep. of Germany

[21] Appl. No.: 889,404

[22] Filed: Jul. 25, 1986

[30] Foreign Application Priority Data

Aug. 7, 1985 [DE] Fed. Rep. of Germany ..... 3528335

[51] Int. Cl.[4] ..... A47C 3/00

[52] U.S. Cl. ..... 297/300; 267/177; 297/301

[58] Field of Search ..... 297/300, 301, 302, 345; 182/202; 267/131, 177, 175; 254/98, 10.5; 74/501 A, 501 C, 501 R, 89.15

[56] References Cited

U.S. PATENT DOCUMENTS

| | | | |
|---|---|---|---|
| 975,601 | 11/1910 | Becker | 74/501 A |
| 2,321,385 | 6/1941 | Harold | 297/301 |
| 2,859,799 | 11/1958 | Moore | 297/301 |
| 3,538,786 | 11/1970 | Coordes et al. | 74/501 C |
| 3,677,601 | 7/1972 | Morrison et al. | 297/457 X |
| 3,989,297 | 11/1976 | Kersholt | 297/300 |
| 4,143,910 | 3/1979 | Geffers et al. | 297/301 |
| 4,384,741 | 5/1983 | Flum et al. | 297/328 |
| 4,432,582 | 2/1984 | Weismann et al. | 297/328 |
| 4,471,994 | 9/1984 | Zünd et al. | 297/300 |
| 4,502,729 | 3/1985 | Locher | 297/320 X |

FOREIGN PATENT DOCUMENTS

| | | | |
|---|---|---|---|
| 264060 | 12/1968 | Australia . | |
| 0018258 | 10/1980 | European Pat. Off. | 74/89.15 |
| 418370 | 10/1934 | United Kingdom | 74/501 C |

*Primary Examiner*—James T. McCall

*Attorney, Agent, or Firm*—Roylance, Abrams, Berdo & Goodman

[57] ABSTRACT

An apparatus for supporting a part of a piece of furniture on another part of the piece of furniture, especially of a backrest support of a desk chair on its lower support, has a spring. The preset spring bias can be adjusted by an adjustment member. A bent link tube has one end which is arranged at the spring and another end supporting the adjustment member for adjusting the spring from a point the spring longitudinal axis. A force transmission member is moved by the adjustment member and is guided in the link tube to work effectively on the spring. A mechanism is also mounted in the link tube for controlling the force exerted from adjustment member on the transmission member.

8 Claims, 4 Drawing Figures

APPARATUS FOR SUPPORTING PARTS OF FURNITURE

FIELD OF THE INVENTION

The present invention relates to an apparatus for supporting parts of a piece of furniture, particularly a backrest support on the lower support of a desk chair.

BACKGROUND OF THE INVENTION

In a conventional desk chair, a spring flexibly supports the backrest support on a stationary lower support part. The spring is supported on the lower support part and on an adjustment nut threaded on a tie rod. The tie rod is connected with the backrest support and acts on the spring. The position of the nut on the tie rod can be adjusted only at the front edge of the seat. This type of chair is disclosed in U.S. Pat. No. 2,321,385 to Herold.

A conventional height-adjustable chair, table or the like has a tubular center post with a bottom extended part arranged to slide on or in another similar tubular trunk. The tubular trunk is perpendicular with a base member. A stop member can be inserted through an opening of the wall of the tubular center post between two adjacent spherical fillers. The fillers are found at a distance from the top end of the trunk corresponding to the desired height adjustment. The stop member is formed by a protuberance connected with the bottom of the seat surface which can be flipped up. This type of chair is disclosed in Austrian Pat. No. 264,060.

SUMMARY OF THE INVENTION

An object of the present invention is to provide an apparatus for supporting parts of furniture wherein the force of a spring is adjustable from a setting point spaced or offset from its longitudinal.

The foregoing object is obtained by an apparatus for supporting parts of a piece of furniture, especially a backrest support of a desk chair on a lower support thereof, comprising a spring, an adjustment member coupled to the spring for varying biasing of the spring, a bent link tube having a first end located at the spring and an opposite second end supporting the adjustment member, and a cylindrical force transmission member connected to and controlled by the adjustment member and guided for sliding movement in the link tube to change the characteristics of the spring. A coupling mechanism is mounted in the link tube for connecting and for controlling the forces exerted by the adjustment member on the force transmission member.

With the adjustment or linking mechanism including a bent link tube, the adjustment member can be located in a wide range of desired points. For example, the adjustment member can be located to the side of the spring when the spring is arranged in longitudinal direction to the chair.

Preferrably, the adjustment member moves in a guide along the longitudinal axis of the adjacent end of the bent link tube.

A plurality of pressure elements can be mounted within the link tube for controlling the spring bias. The coupling mechanism can include an easily deformable mass between piston shaped parts of the adjustment member and the force transmission member projecting into the link tube.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF PREFERRED EMBODIMENT

Figure 1:
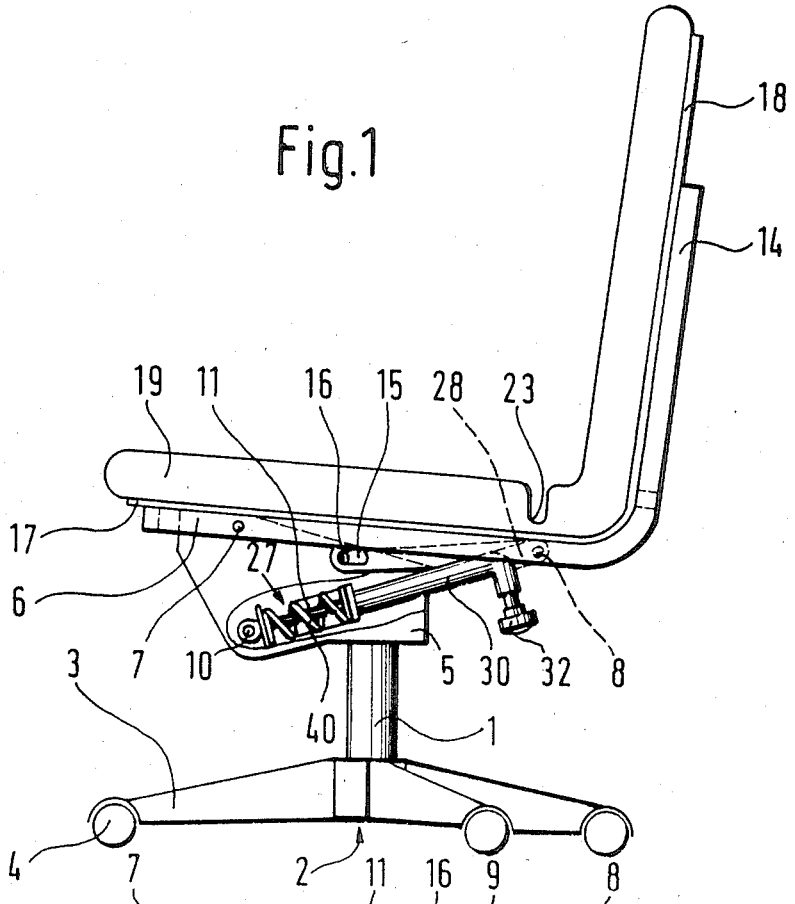
FIG. 1 is a side elevational view of a tiltable desk chair according to the present invention.

A center post or support column 1, which support column can be raised and lowered by an adjustable pneumatic spring, is mounted on an undercarriage or movable base 2. The undercarriage has five arms or feet 3 arranged in a star shape with a roller or caster 4 at the end of each arm. A lower support or frame 5 is mounted on an extendible part of column 1. A seat support 6 is arranged above and is pivotally mounted adjacent its front end to lower support 5 by means of seat support bearings 7 having a first horizontal axis. A connection hinge or joint 8, configured as a multiple bearing, is mounted adjacent the rear end of seat support 6. One end of a blockable pneumatic spring 9 is supported on connection joint 8. The other end of pneumatic spring 9 is coupled to lower support 5 by means of a spring bearing 10 located beneath seat support bearings 7.

Pneumatic spring 9 has a piston rod which moves in and out of its housing on the side adjacent the spring bearing 10. On the part of the piston rod protruding from the housing, an additional spring 11, configured as a helical spring, is provided to surround the pneumatic spring. Additional spring 11 is tensioned between two spring plates 12 and 13. Spring plate 12 abuts the additional spring at its side adjacent spring bearing 10 on the piston rod. Spring plate 13 abuts the additional spring adjacent to and is supported on the housing of pneumatic spring 9.

Connection joint 8 also pivotally couples, at bearing 24, the rear side of seat support 6 to front side of backrest support 14. The backrest support is generally L-shaped in the side elevational view of FIG. 1. In the position illustrated in FIG. 1, the backrest support has an end engaged beneath seat support 6 and between seat support 6 and pneumatic spring 9. Backrest support 14 has a longitudinal aperture or hole 15 at its free end beneath seat support 6. Aperture 15 engages a guide pin 16 fixedly mounted on lower support 5.

A seat 17 is mounted on seat support 6, and a backrest 18 is mounted on the side of backrest support 14 facing seat 17. A unitary, one-piece chair pad 19 extends from the front edge of seat 17 to the top of backrest 18. In the area of connection joint 8, a pad hinge is formed by a notch or cutout 23 in seat pad 19.

Figure 2:
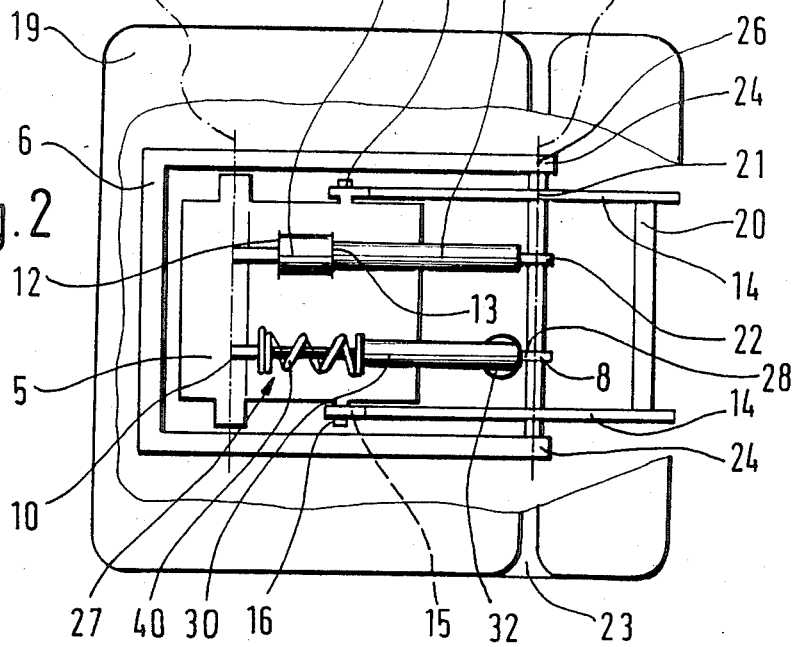
FIG. 2 is a top plan view of the tiltable desk chair of FIG. 1 with portions broken away.

In FIG. 2, backrest support 14 has two adjacent struts or cross beams 21 connected to each other by a connecting rod 20. Seat support 6 is U-shaped in plan view, and surrounds lower support 5 on its front and its lateral sides. Seat support 6 also surrounds the crossbeams, which crossbeams are arranged adjacent the sides of the seat support. Each of the two front support bearings 15 and 16 is associated with a rear backrest support bearing 21, and a seat support bearing 26 is associated with each of the front seat support bearings 7. Bearings 21 and 26 are coaxially arranged and form the connection joint 8 (FIG. 1) which is configured as multiple bearing.

In FIG. 2, a spring mechanism 27 is associated with pneumatic spring 9. The spring mechanism is shown in greater scale in FIG. 3, Pneumatic spring 9 and spring mechanism 27 are arranged parallel to each other. A vertical plane passing through the middle of the seat support is located centrally between pneumatic spring 9 and spring mechanism 27.

Figures 3, 4:
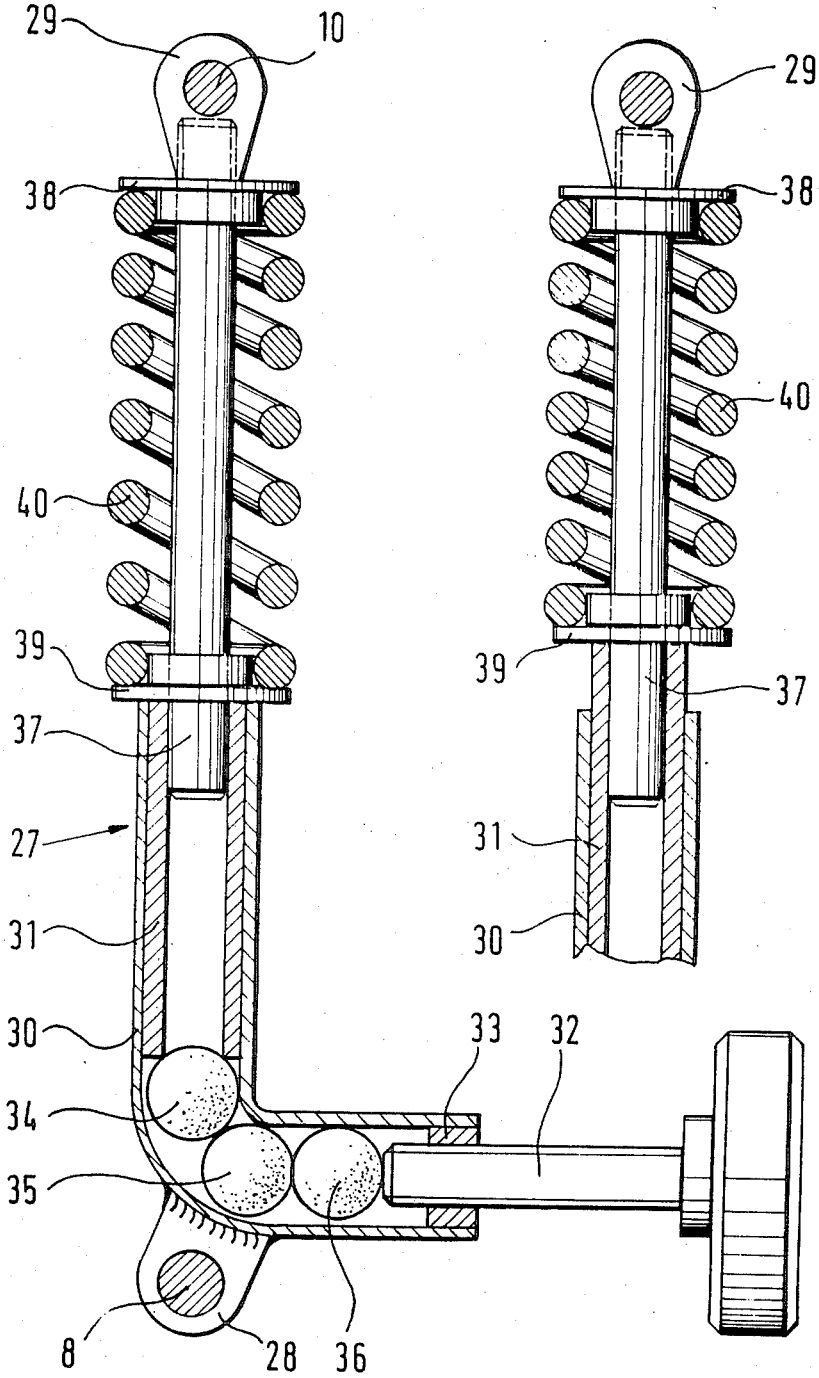
FIG. 3 is an enlarged side elevational view in section illustrating the spring and adjustment mechanism of the tiltable desk chair of FIG. 1.
FIG. 4 is a partial side elevational view in section of the spring and adjustment mechanism of FIG. 3 in a different position.

Spring mechanism 27 is coupled with a part of connection joint 8 by a connector 28. Connection joint 8 is mounted on the elbow joint of a bent link tube 30. Connection joint 8 passes through connector 28. A tubular member 31 can be inserted telescopically into one end of link tube 30, and serves as force transmission member. In the link tube opposite end, i.e., its right end as shown in FIG. 3, an adjustment member 32 is mounted. Adjustment member 32 has a screw thread threaded in a nut 33 mounted in the tube end. The longitudinal axes of tubular force transmission member 31 and adjustment member 32 are substantially perpendicular to each other. The axes can also form an acute or obtuse angle. Three pressure elements 34, 35 and 36, configured as spheres or balls, are provided between tubular member 31 and adjustment member 32 in link tube 30, and can be moved along the link tube.

A helical spring 40 is arranged on a rod 37 between two spring plates 38 and 39. Rod 37 projects into tubular member 31. On the end of rod 37 remote from tubular member 31, a fastener 29 is attached to spring bearing 10 passing through fastener 29.

Link tube 30 with fastener 28 mounted thereon can be configured so that adjustment member 32 can be set in different positions in the desk chair. Adjustment member 32 in FIG. 1 is located beneath backrest 18 and projects downwardly.

In the position shown in FIG. 3, spring plate 39 rests on one end of link tube 30. By threading adjustment member 32 into link tube 30, due to the rigid or fixed spacing of connection 28 and fastener 29, helical spring 40, as shown in FIG. 4, is more strongly prebiased. With the partial extension of tubular member 31 outside of link tube 30, spring plate 39 is removed from the end of link tube 30.

Tubular member 31 and adjustment member 32 are configured at least partially as pistons, especially as plunger pistons. In this manner, the force exerted on helical spring 40 can be applied by an easily deformable, practically incompressible mass, instead of a fluid mass, by means of pressure elements 34 to 36, for transmitting the force exerted by adjustment member 32 on helical spring 40.

Pneumatic spring 9 and spring mechanism 27 work together. Blockable pneumatic spring 9 determines the position of connecting joint 8. On account of the gas pads in pneumatic spring 9, connecting joint 8 can give downwardly upon application of a load. Pneumatic spring 9 can be replaced by a spring mechanism 27. The unloaded spring mechanisms then work against a stop determined by their bias. With the presence of a pneumatic spring, the length of the unloaded spring mechanism is determined by the momentary length of the pneumatic spring. In the absence of a pneumatic spring, the length of the unloaded spring mechanism is then determined by the associated stop.

While a particular embodiment has been chosen to illustrate the invention, it will be understood by those skilled in the art that various changes and modifications can be made therein without departing from the scope of the invention as defined in the appended claims.

What is claimed is:

1. An apparatus for supporting parts of a piece of furniture, especially a backrest support of a desk chair on a lower support thereof, comprising:

a spring with first and second ends, said first end of said spring abutting a pivotally mounted plate;

an adjustment member coupled to said spring for varying biasing of said spring;

a bent link tube having a first end located at said second end of said spring and an opposite second end supporting said adjustment member;

a cylindrical force transmission member connected to and controlled by said adjustment member, and guided for sliding movement in said link tube to change characteristics of said spring; and coupling means, mounted in said link tube, for connecting and for controlling forces exerted by said adjustment member on said force transmission member.

2. An apparatus according to claim 1 wherein said adjustment member is moveable along a longitudinal axis of a guide and projects into said link tube, said guide extending parallel a longitudinal axis of said second end of said link tube.

3. An apparatus according to claim 2 wherein said coupling means comprises a plurality of pressure elements having outer dimensions corresponding to an inner diameter of said link tube.

4. An apparatus according to claim 1 wherein said coupling means comprises a plurality of pressure elements having outer dimensions corresponding to an inner diameter of said link tube.

5. An apparatus according to claim 2 wherein said adjustment member and said force transmission member comprise piston shaped portions projecting into said link tube; and said coupling means comprises an easily deformable, essentially incompressible mass.

6. An apparatus according to claim 1 wherein said ends of said bent tube have longitudinal axes oriented at an angle.

7. An apparatus according to claim 1 wherein said link tube comprises a bend intermediate said ends thereof and a pivot joint adjacent said bend.

8. An apparatus according to claim 1 wherein said spring is arranged on a rod projecting into said force transmission member and through said plate to engage pivotally a spring bearing.

* * * * *